US006739431B1

(12) United States Patent
Wang

(10) Patent No.: US 6,739,431 B1
(45) Date of Patent: May 25, 2004

(54) ELEVATOR ESCAPE DEVICE

(76) Inventor: Jiun Jyh Wang, No. 50, Alley 97 Lane 354, San Her Rd., Feng Yuan, Taichung Hsien (TW)

( * ) Notice: Subject to any disclaimer, the term of this patent is extended or adjusted under 35 U.S.C. 154(b) by 0 days.

(21) Appl. No.: 10/388,712

(22) Filed: Mar. 13, 2003

(51) Int. Cl.[7] ..... B66B 1/02
(52) U.S. Cl. ..... 187/306; 187/901; 187/314
(58) Field of Search ..... 187/306, 290, 187/313–316, 348, 901, 414; 49/116–123, 139, 140

(56) References Cited

U.S. PATENT DOCUMENTS 4,650,036 A * 3/1987 Matsuda ..... 187/239
5,329,075 A * 7/1994 Hirabayashi et al. ..... 187/316
5,693,919 A * 12/1997 Sager et al. ..... 187/282
6,164,417 A * 12/2000 Oberleitner ..... 187/319
6,189,658 B1 * 2/2001 Karner ..... 187/319
6,508,332 B2 * 1/2003 Fahl et al. ..... 187/316

FOREIGN PATENT DOCUMENTS

JP 54108334 A * 8/1979 ..... B66B/13/16
JP 03152083 A * 6/1991 ..... B66B/13/14

* cited by examiner

*Primary Examiner*—Jonathan Salata
(74) *Attorney, Agent, or Firm*—Pro-Techtor International Services

(57) ABSTRACT

An escape device of elevator. The device includes an activation assembly comprising sheaves, rope, links, flexible board, roller, guide, limit member, bar, and catch; and an operation assembly comprising sheaves, ropes, links rotating disk, weight, cylinder having a wall aperture, and spring depressible shaft. In case of emergency a manual rotation of the sheave will cause the shaft to remove a support to the weight in the cylinder by retracting from the aperture. Hence, the weight begins to fall to pull the rope. Eventually, an elevator door is opened automatically. The invention can also be configured to facilitate an operation by the handicapped.

2 Claims, 5 Drawing Sheets

FIG, 1
PRIOR ART

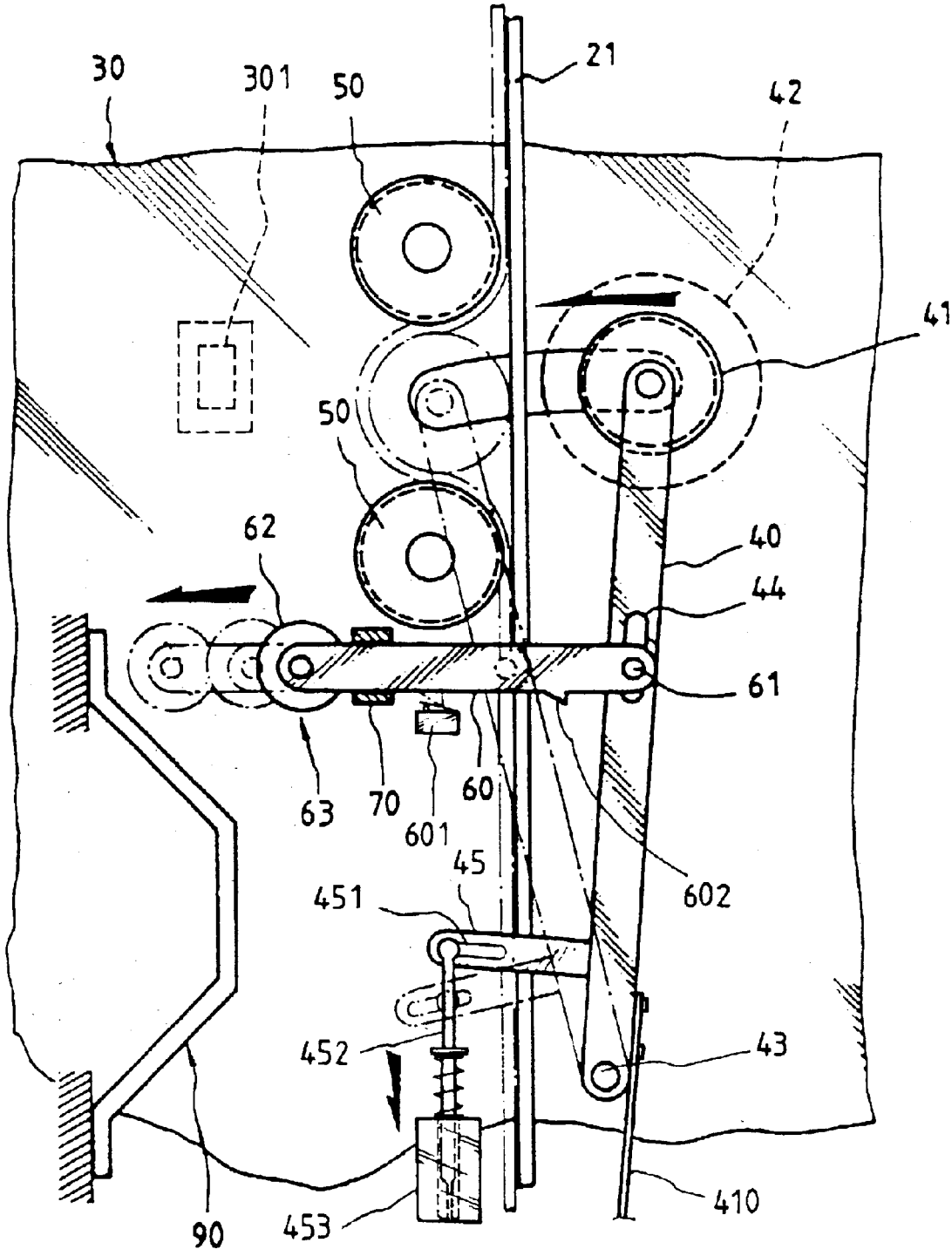
FIG,5

ELEVATOR ESCAPE DEVICE

FIELD OF THE INVENTION

The present invention relates to escape devices of elevator and more particularly to an improved escape device for automatically opening door of an elevator in case of emergency.

BACKGROUND OF THE INVENTION

A conventional escape device of elevator is shown in FIG. 1. The device comprises an activation assembly 100 and an operation assembly 200. The activation assembly 100 is provided in a car 300 and comprises a rectangular window 101 hingedly coupled to a wall recess 302, an electromagnetic switch 103 on a side of the recess 302, a cylinder 104 inside the wall of the car 300 an exposed portion 105 in the cylinder 104, a weight 106 received in the cylinder 104, a plurality of ring grooves 107 around the weight 106, a hook 110 at the exposed portion 105, a spring 108 coupled to the hook 110 so that a sharp end of the hook 110 can support the weight 106, a stop 120 in an inner surface of the window 101 for supporting the hook 110, a magnet 111 within the wall of the car 300 for pivoting the hook 110 when the car 300 is stopped at a predetermined position of each floor, a rope 112 having one end inserted through the weight 106, and a plurality of sheaves 113 for guiding the other end of the rope 112 to and secured to a first link 201 of the operation assembly 200. The operation assembly 200 further comprises a rotating disk 202 coupled to the first link 201, two opposite second links 203 having one ends pivotably coupled to the disk 202, and two opposite sliding brackets 205 at the top of a door 204.

In case of power outage including an emergency power supply failure, the car 300 is stopped immediately and the door 104 cannot be opened at this time. In response, the window 101 is opened automatically as the switch 103 is disabled. Next, the hook 110 is disengaged from the stop 120 and then is attracted by the magnet 111 for disengaging from the groove 107. The weight 106 drops immediately to a bottom of the cylinder 104. At the same time, one end of the rope 112 is pulled downward to cause the disk 202 to rotate as the rope 112 moves over the sheaves 113 to activate the first link 201. Next, the brackets 205 move toward each other as activated by the second links 203. Eventually, the door 204 is opened for enabling persons trapped in the car 300 to escape safely.

However, the prior art suffered from a disadvantage. For example, it can function well only after opening the window 101 and the hook 110 is disengaged from the groove 107. Unfortunately, the automatic opening of the window 101 is often disabled in case of emergency. Thus, the need for improvement still exists.

SUMMARY OF THE INVENTION

It is therefore an object of the present invention to provide an escape device of elevator comprising an activation assembly comprising a first rope extended down to a side of a car by passing a plurality of first sheaves, a second sheave coupled to one end of a first link, a third sheave in the car being coaxial with the second sheave, a pivot at the other end of the first link, a flexible board having one end coupled to the pivot, a second link having one end slidably coupled to an elongated groove in the first link and the other end coupled to a roller, a guide for permitting the second link to slide through, a projected limit member in the car, a bar proximate the other end of the first link, the bar being perpendicular to the first link, and a catch adjacent the bar, and an operation assembly comprising a second rope having one end coupled to a protrusion of a rotating disk, two opposite third links pivotably coupled to the rotating disk and a top of a door of the car respectively, a weight at the other end of the second rope, a vertical cylinder within a wall of the car for permitting the weight to slide therein, a plurality of fourth sheaves for guiding the second rope between the weight and the protrusion, an aperture in a wall of the cylinder, a spring depressible shaft adjacent the aperture, a wedge at one end of the shaft, the wedge being projected into the cylinder to support the weight in a normal state, a third rope coupled between the other end of the shaft and the other end of the flexible board, and a plurality of fifth sheaves for guiding the third rope between the other end of the shaft and the other end of the flexible board; wherein in response to a stop of the elevator in case of emergency, the first link pivots as the third sheave is rotated manually, the second sheave pivots to a position between the first sheaves so as to pull the first rope for activating the activation assembly, one end of the second link slides in the groove in response to the pivoting of the first link, the second link then moves toward the limit member along the guide, the bar pivots to be caught by the catch, the car will begin to lower as activated by the activation assembly if the car stops at a position between two adjacent floors, the roller is enabled by the limit member once the car has lowered to be flush with the immediately lower floor, the second link is pushed back to its original position, the first link returns to its original position, the bar is disengaged from the catch, the flexible board is flexed about the pivot to pull the third rope, the wedge moves out of the cylinder by the pulling of the third rope, the weight falls down to a lowest position in the cylinder as the support of the wedge is removed, the second rope is pulled to rotate the disk, the third links pivots in response to the rotation of the disk, and eventually the door is opened.

It is another object of the present invention to provide an escape device of elevator comprising an activation assembly comprising a first rope extended down to a side of a car by passing a plurality of first sheaves, a second sheave coupled to one end of a first link, a third sheave in the car being coaxial with the second sheave, a pivot at the other end of the first link, a flexible board having one end coupled to the pivot, a second link including a latched member and having one end slidably coupled to an elongated groove in the first link and the other end coupled to a roller, a guide for permitting the second link to slide through, a projected limit member in the car, a bar proximate the other end of the first link, the bar being perpendicular to the first link and including an elongated slot in its downstream, a spring biased lever slidably coupled to the slot, a driver powered by a standby power source for activating the spring biased lever, a limit switch adjacent the guide, an activation button on a wall of the car, and a catch adjacent the bar; and an operation assembly comprising a second rope having one end coupled to a protrusion of a rotating disk, two opposite third links pivotably coupled to the rotating disk and a top of a door of the car respectively, a weight at the other end of the second rope, a vertical cylinder within a wall of the car for permitting the weight to slide therein, a plurality of fourth sheaves for guiding the second rope between the weight and the protrusion, an aperture in a wall of the cylinder, a spring depressible shaft adjacent the aperture, a wedge at one end of the shaft, the wedge being projected into the cylinder to support the weight in a normal state, a third rope coupled between the other end of the shaft and the other end of the flexible board, and a plurality of fifth sheaves for guiding the third rope between the other end of the shaft and the other end of the flexible board; wherein in response to a stop of the elevator in case of emergency, the activation button is pushed manually, the driver is then activated, the spring biased lever is pulled down, the bar pivots downward to cause the spring biased lever to slide in the slot, the first link pivots to cause the second sheave to pivot to a position between the first sheaves so as to pull the first rope for activating the activation assembly, the car will begin to lower as activated by the activation assembly, if the car stops at a position between two adjacent floors, the roller is enabled by the limit member once the car has lowered to be flush with the immediately lower floor, the second link is pushed back toward its original position, the limit switch is enabled once the latched member has returned to its original position, the driver is disabled by the limit switch, the first link returns to its original position, the bar is disengaged from the catch, the flexible board is flexed about the pivot to pull the third rope, the wedge moves out of the cylinder by the pulling of the third rope, the weight falls down to a lowest position in the cylinder as the support of the wedge is removed, the second rope is pulled to rotate the disk, the third links pivots in response to the rotation of the disk, and eventually the door is opened. This design is particularly suited for the handicapped.

The above and other objects, features and advantages of the present invention will become apparent from the following detailed description taken with the accompanying drawings.

BRIEF DESCRIPTION OF THE DRAWINGS

FIG. 5 is a side view schematically showing components of an escape device of elevator according to a second preferred embodiment of the invention.

DETAILED DESCRIPTION OF THE PREFERRED EMBODIMENTS

Figure 1:
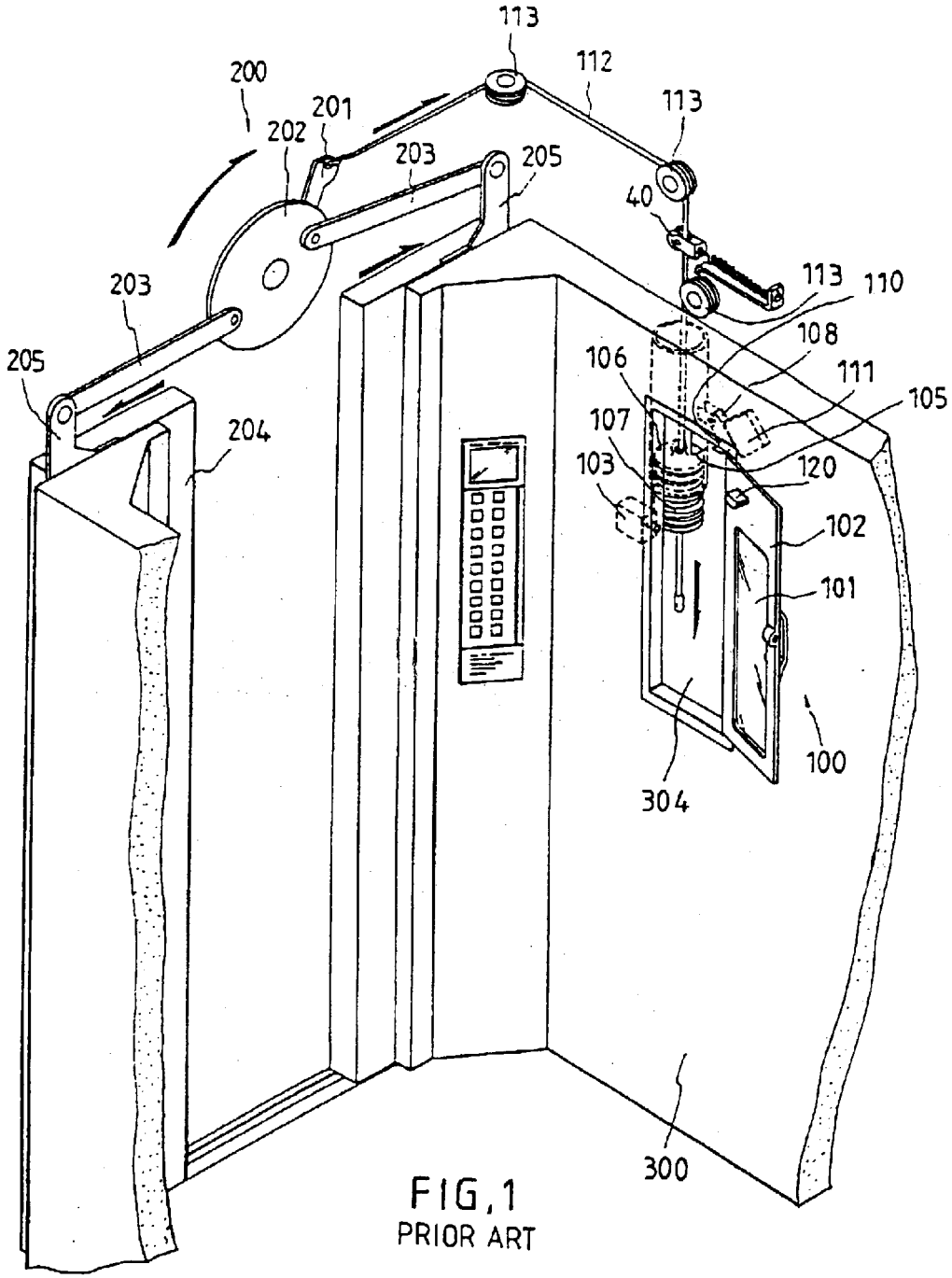
FIG. 1 is a perspective view schematically showing a conventional escape device of elevator, the device being capable of automatically opening door of the elevator in case of emergency.
Figure 2:
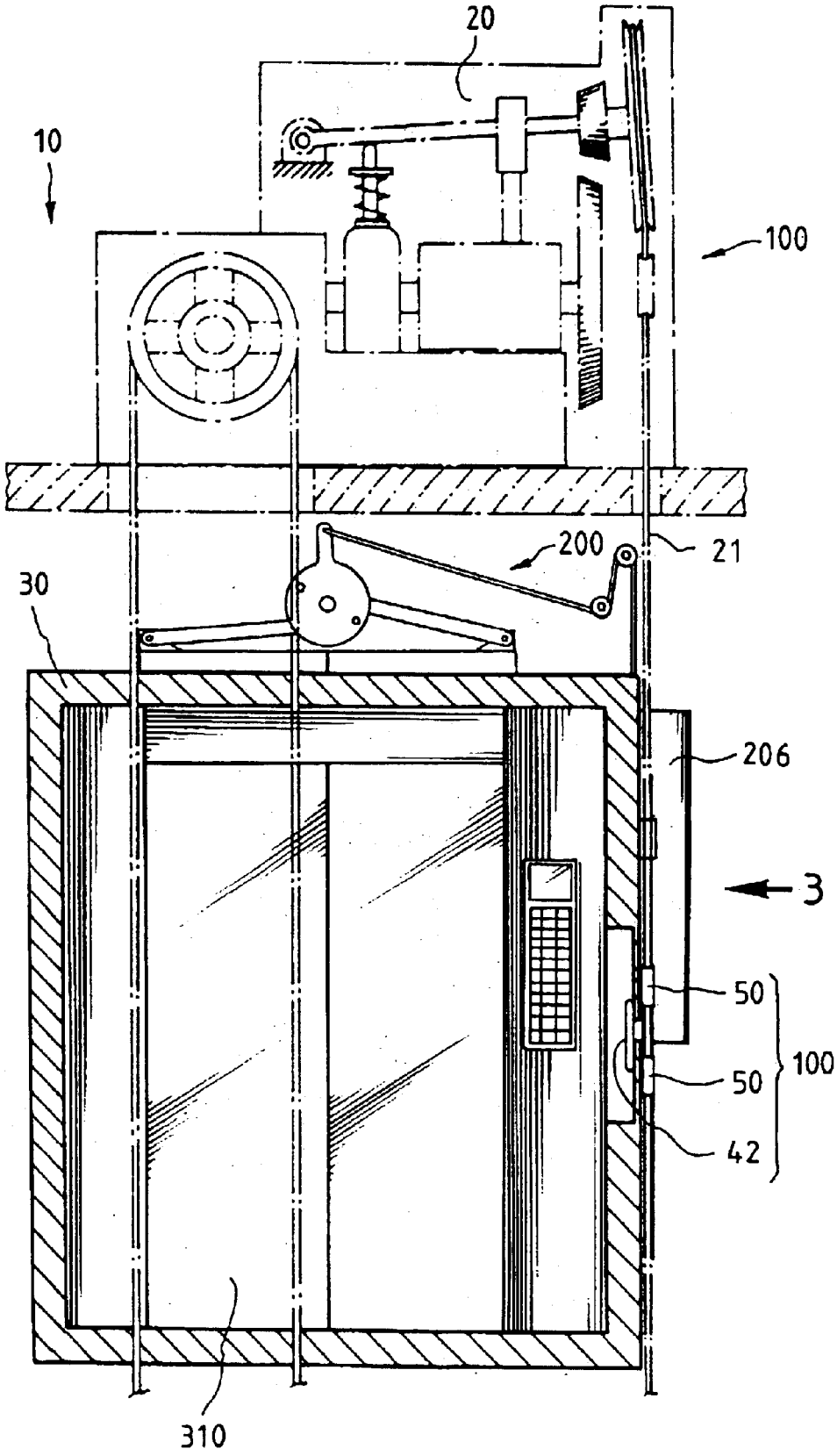
FIG. 2 is a schematic drawing of a first preferred embodiment of escape device of elevator according to the invention.
Figure 3:
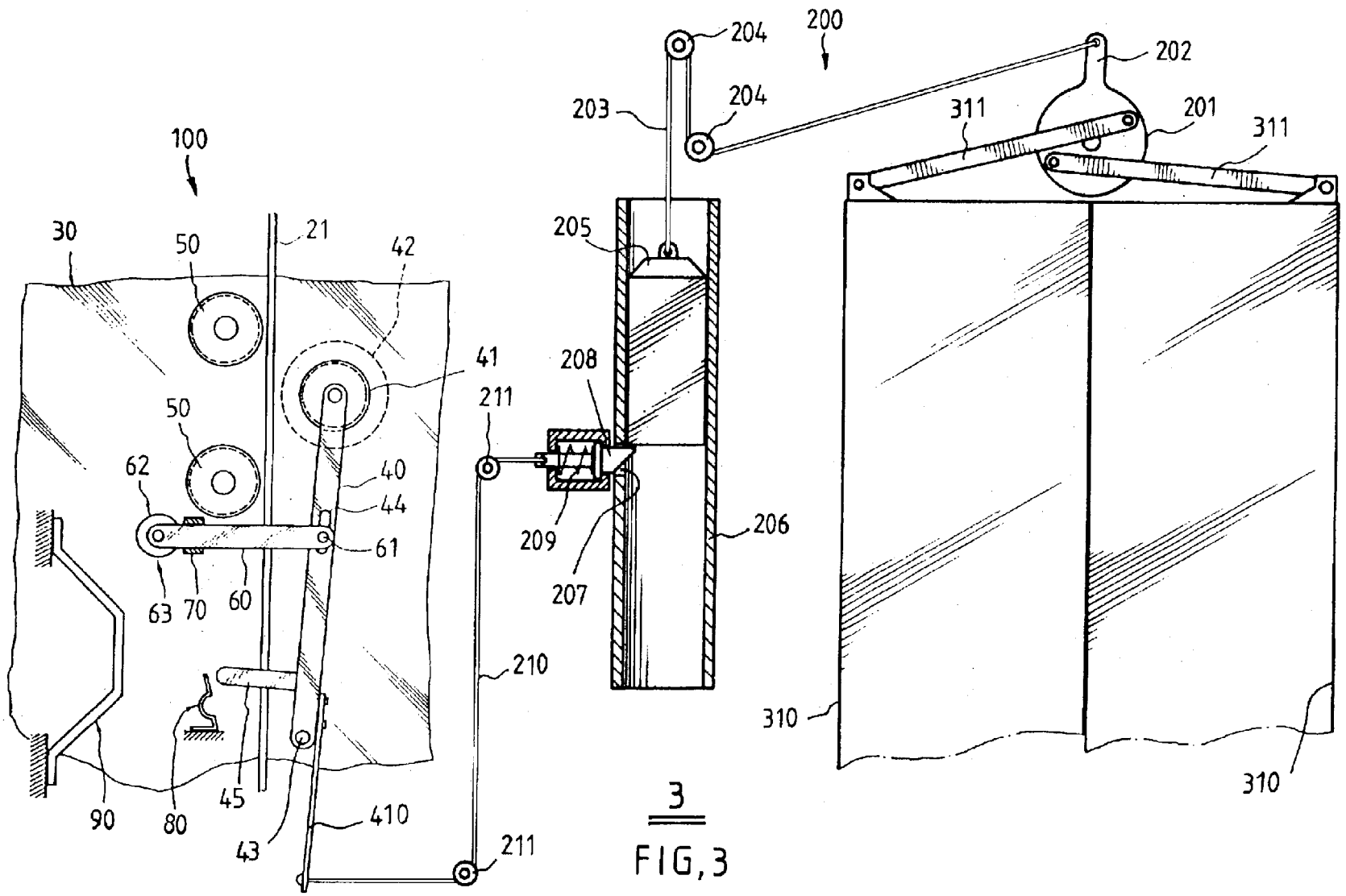
FIG. 3 depicts schematically components of the escape device.

Referring to FIGS. 2 and 3, there is shown an escape device of elevator constructed in accordance with a first preferred embodiment of the invention comprising an activation assembly 100 and an operation assembly 200. The activation assembly 100 comprises an activation mechanism 20 in a mechanical room 10 above a car 30 by a predetermined distance. The activation mechanism 20 is enabled in case of emergency and comprises a first rope 21 extended down to a side of the car 30 by passing two first sheaves 50, a second sheave 41 coupled to one end of a first link 40, a third sheave 42 in the car 30 being coaxial with the second sheave 41, a pivot 43 formed at the other end of the first link 40, a flexible board 410 having one end coupled to the pivot 43, a second link 60 having one end 61 slidably coupled to an elongated groove 44 in the first link 40 and the other end 63 coupled to a roller 62, a guide 70 with the shank of the second link 60 slidably passed through, a projected limit member 90 in the car 30, a bar 45 coupled to a position proximate the other end of the first link 40, the bar 45 being perpendicular to the first link 40, and a catch 80 adjacent the bar 45.

The operation assembly 200 is provided between the car 30 and the activation mechanism 20. The operation assembly 200 comprises a second rope 203 having one end coupled to a protrusion 202 projected from a rotating disk 201. The rotating disk 201 is also pivotably coupled to two opposite third links 311 which are in turn pivotably coupled to the top of a door 310 of the car 30. The operation assembly 200 further comprises a weight 205 at the other end of the second rope 203, a vertical cylinder 206 within the wall of the car 30 for permitting the weight 205 to slide therein, a plurality of fourth sheaves 204 or guiding the second rope 203 between the weight 205 and the protrusion 202, an aperture 207 in the wall of the cylinder 206, a spring depressible shaft 209 adjacent the aperture 207, a wedge 208 formed at one end of the shaft 209, the wedge 208 being capable of moving into or out of the cylinder 206 via the aperture 207 as the shaft 209 is expanded or compressed in which the wedge 208 is projected into the cylinder 206 to support the weight 205 in a normal state, a third rope 210 coupled between the other end of the shaft 209 and the other end of the flexible board 410, and a plurality of fifth sheaves 211 for guiding the third rope 210 between the other end of the shaft 209 and the other end of the flexible board 410.

Figure 4:
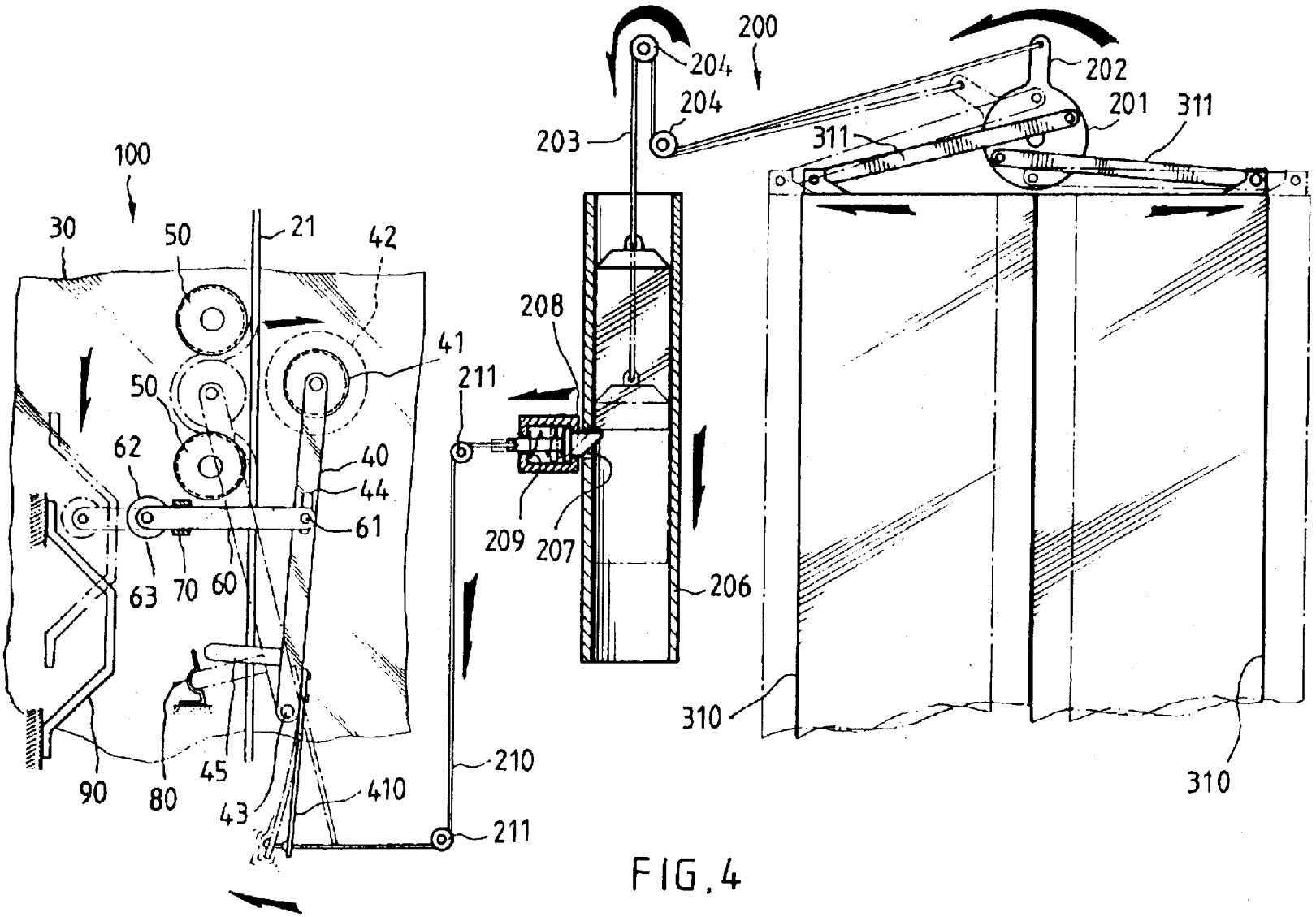
FIG. 4 is a view similar to FIG. 3 showing an operation of the device in case of emergency.

Referring to FIG. 4, an operation of the invention in response to an emergency (e.g., power outage including an emergency power supply failure) will now be described in detail below. The elevator will stop hoisting or lowering immediately. At this time, the first link 40 pivots as the third sheave 42 is rotated by manipulating by a trapped person. Next, the second sheave 41 pivots to a position between the first sheaves 50 so as to pull the first rope 21 for activating the activation mechanism 20. One end 61 of the second link 60 slides in the groove 44 in response to the pivoting of the first link 40. The second link 60 then moves toward the limit member 90 along the guide 70. At the same time, the bar 45 pivots is caught by the catch 80. For example, if the car 30 stops at a position between two adjacent floors. This is often for elevator in case of emergency. The car 30 will begin to lower as activated by the activation mechanism 20. The roller 62 is enabled by the limit member 90 once the bottom of the car 30 has lowered to a position flush with the immediately lower floor. As such, the second link 60 is pushed back to its original normal position. At the same time, the first link 40 returns to its original normal position. Also, the bar 45 is disengaged from the catch 80. The flexible board 410 is then flexed about he pivot 43 to pull the third rope 210 in response to the return of the first link 40. The wedge 208 then moves out of the cylinder 206 by the pulling of the third rope 210. Immediately, the weight 205 falls down to a lowest position in the cylinder 206 as the support of the wedge 208 is removed. Next, the second rope 203 is pulled to rotate the disk 201. The third links 311 then pivots in response to the rotation of the disk 201. As a result, the door 310 is opened.

Referring to FIG. 5, there is shown an escape device of elevator constructed in accordance with a second preferred embodiment of the invention. The second preferred embodiment substantially has same structure as the first preferred embodiment. The differences between the first and the second preferred embodiments, i.e., the characteristics of the second preferred embodiment are detailed below. An elongated groove 451 is formed in the downstream of the bar 45. A spring biased lever 452 is slidably coupled to the groove 451. A driver 453 such as an electric driver is provided to activate the spring biased lever 452. A limit switch 601 is provided adjacent the guide 70. A latched member 602 is formed on the second link 60. An activation button 301 is provided on the wall of the car 30. The second preferred embodiment may facilitate the operation of the invention by the handicapped. In detail, in case that a handicapped person is trapped in an elevator. The person can use his/her head or hand to push the activation button 301. The driver 453 is then activated by a standby power source. Next, the spring biased lever 452 is pulled down. And in turn, the bar 45 pivots downward to cause the spring biased lever 452 to slide in the groove 451. Next, the first link 40 pivots leftward (as seen in FIG. 5) to cause the second sheave 41 to pivot to a position between the first sheaves 50 so as to pull the first rope 21 for activating the activation mechanism 20. The car 30 will begin to lower as activated by the activation mechanism 20. When the bottom of the car 30 has lowered to a position flush with the immediately lower floor, the roller 62 will be enabled by the limit member 90. As such, the second link 60 is pushed back toward its original normal position. Also, the limit switch 601 is enabled once the latched member 602 has return to its original normal position. The driver 453 is then disabled by the limit switch 601. Eventually, the first link 40 returns to its original normal position once the second link 60 has returned to its original normal position. The opening of the door 310 of the second embodiment will not be described in detail below since it is the same as that described in the first embodiment.

While the invention has been described by means of specific embodiments, numerous modifications and variations could be made thereto by those skilled in the art without departing from the scope and spirit of the invention set forth in the claims.

What is claimed is:

1. An escape device of elevator comprising:

an activation assembly comprising a first rope extended down to a side of a car by passing a plurality of first sheaves, a second sheave coupled to one end of a first link, a third sheave in the car being coaxial with the second sheave, a pivot at the other end of the first link, a flexible board having one end coupled to the pivot, a second link having one end slidably coupled to an elongated groove in the first link and the other end coupled to a roller, a guide for permitting the second link to slide through, a projected limit member in the car, a bar proximate the other end of the first link, the bar being perpendicular to the first link, and a catch adjacent the bar; and an operation assembly comprising a second rope having one end coupled to a protrusion of a rotating disk, two opposite third links pivotably coupled to the rotating disk and a top of a door of the car respectively, a weight at the other end of the second rope, a vertical cylinder within a wall of the car for permitting the weight to slide therein, a plurality of fourth sheaves for guiding the second rope between the weight and the protrusion, an aperture in a wall of the cylinder, a spring depressible shaft adjacent the aperture, a wedge at one end of the shaft, the wedge being projected into the cylinder to support the weight in a normal state, a third rope coupled between the other end of the shaft and the other end of the flexible board, and a plurality of fifth sheaves for guiding the third rope between the other end of the shaft and the other end of the flexible board;

wherein in response to a stop of the elevator in case of emergency, the first link pivots as the third sheave is rotated manually, the second sheave pivots to a position between the first sheaves so as to pull the first rope for activating the activation assembly, one end of the second link slides in the groove in response to the pivoting of the first link, the second link then moves toward the limit member along the guide, the bar pivots to be caught by the catch, the car will begin to lower as activated by the activation assembly if the car stops at a position between two adjacent floors, the roller is enabled by the limit member once the car has lowered to be flush with the immediately lower floor, the second link is pushed back to its original position, the first link returns to its original position, the bar is disengaged from the catch, the flexible board is flexed about the pivot to pull the third rope, the wedge moves out of the cylinder by the pulling of the third rope, the weight falls down to a lowest position in the cylinder as the support of the wedge is removed, the second rope is pulled to rotate the disk, the third links pivots in response to the rotation of the disk, and eventually the door is opened.

2. An escape device of elevator comprising:

an activation assembly comprising a first rope extended down to a side of a car by passing a plurality of first sheaves, a second sheave coupled to one end of a first link, a third sheave in the car being coaxial with the second sheave, a pivot at the other end of the first link, a flexible board having one end coupled to the pivot, a second link including a latched member and having one end slidably coupled to an elongated groove in the first link and the other end coupled to a roller, a guide for permitting the second link to slide through, a projected limit member in the car, a bar proximate the other end of the first link, the bar being perpendicular to the first link and including an elongated slot in its downstream, a spring biased lever slidably coupled to the slot, a driver powered by a standby power source for activating the spring biased lever, a limit switch adjacent the guide, an activation button on a wall of the car, and a catch adjacent the bar; and an operation assembly comprising a second rope having one end coupled to a protrusion of a rotating disk, two opposite third links pivotably coupled to the rotating disk and a top of a door of the car respectively, a weight at the other end of the second rope, a vertical cylinder within a wall of the car for permitting the weight to slide therein, a plurality of fourth sheaves for guiding the second rope between the weight and the protrusion, an aperture in a wall of the cylinder, a spring depressible shaft adjacent the aperture, a wedge at one end of the shaft, the wedge being projected into the cylinder to support the weight in a normal state, a third rope coupled between the other end of the shaft and the other end of the flexible board, and a plurality of fifth sheaves for guiding the third rope between the other end of the shaft and the other end of the flexible board;

wherein in response to a stop of the elevator in case of emergency, the activation button is pushed manually, the driver is then activated, the spring biased lever is pulled down, the bar pivots downward to cause the spring biased lever to slide in the slot, the first link pivots to cause the second sheave to pivot to a position between the first sheaves so as to pull the first rope for activating the activation assembly, the car will begin to lower as activated by the activation assembly, if the car stops at a position between two adjacent floors, the roller is enabled by the limit member once the car has lowered to be flush with the immediately lower floor, the second link is pushed back toward its original position, the limit switch is enabled once the latched member has returned to its original position, the driver is disabled by the limit switch, the first link returns to its original position, the bar is disengaged from the catch, the flexible board is flexed about the pivot to pull the third rope, the wedge moves out of the cylinder by the pulling of the third rope, the weight falls down to a lowest position in the cylinder as the support of the wedge is removed, the second rope is pulled to rotate the disk, the third links pivots in response to the rotation of the disk, and eventually the door is opened.

* * * * *